United States Patent [19]

Varlet

[11] Patent Number: 4,707,004

[45] Date of Patent: Nov. 17, 1987

[54] LATCH ASSEMBLY

[76] Inventor: Marc F. Varlet, 8 rue des Ecoles, 56410 Etel, France

[21] Appl. No.: 787,626

[22] Filed: Oct. 11, 1985

Related U.S. Application Data

[62] Division of Ser. No. 603,297, Apr. 24, 1984.

[30] Foreign Application Priority Data

Apr. 29, 1983 [FR] France ..... 83 07546

[51] Int. Cl.[4] ..... E05C 17/52

[52] U.S. Cl. ..... 292/91; 292/DIG. 38; 292/DIG. 53; 292/DIG. 60

[58] Field of Search ..... 292/76, 91, 318, 19, 292/80, DIG. 53, DIG. 60, DIG. 38

[56] References Cited

U.S. PATENT DOCUMENTS

| | | | |
|---|---|---|---|
| 548,568 | 10/1895 | Malmstrom | 292/318 |
| 1,147,530 | 7/1915 | Menty | 292/19 |
| 1,183,464 | 5/1916 | Johnson | 292/80 X |
| 3,302,965 | 2/1967 | Hasth et al. | 292/76 |
| 3,315,999 | 4/1967 | Hahn et al. | 292/76 |
| 3,328,061 | 6/1967 | Whistler, Sr. et al. | 292/76 |
| 4,432,574 | 2/1984 | Varlet | 292/91 |

*Primary Examiner*—Richard E. Moore

*Attorney, Agent, or Firm*—Marvin Feldman

[57] ABSTRACT

The device has a first piece mounted on the frame and a second piece mounted on the leaf (or vice versa). The first piece contains two horns defining two rigid bearing surfaces with a groove in between. The second piece is formed by a base mounted on a leaf (or frame), a flexible arm integral with the base and a catch tenon or latch piece integral with the free end of the flexible arm. At closing, the arm lodges automatically in the groove. The first and second pieces are each composed of two parts of which the first is secured to the frame (or leaf), this first part containing a slide-way (or slide) whereas the second part which contains the locking mechanism has at its base a slide (or cooperating slideway) adapted to the slide-way (or slide) of the first part.

3 Claims, 10 Drawing Figures

LATCH ASSEMBLY

This is a division of application Ser. No. 603,297, filed Apr. 24, 1984.

FIELD OF THE INVENTION

The present invention concerns improved devices limiting the distance that a leaf of a door, window or drawer may be opened, the leaf opening as a french door or window or as a sliding door or window.

BACKGROUND AND DISCUSSION OF THE PRIOR ART

Heretofore, devices have been provided to prevent a small child from opening doors and windows in the home, particularly when the child has slipped away from parental surveillance.

In the field concerning the apparatus, the prior art may be elucidated by the U.S. Pat. Nos. 3,889,992 and 3,397,001 and the patent application E.P.A. No. 62,598.

The present applicant has filed E.P.A. No. 62,598 and U.S. Ser. No. 363,418, filed Mar. 30, 1982, now U.S. Pat. No. 4,432,579, granted Feb. 21, 1984.

In the patent application E.P.A. No. 62,589, the conditions to be met were the following:

(a) the apparatus must engage automatically at closing of the door or window leaf to avoid forgetting;

(b) it should be possible to mount the apparatus on swinging and sliding doors, on french and sash windows;

(c) the disengagement of the apparatus, in order to open the door or window should be very difficult or impossible for a child; and (d) for communicating doors, the disengagement should be possible from either side of the door.

The device described in the patent application E.P.A. No. 62,589, and U.S. Pat. No. 4,432,574 filled these conditions, whereas those described in the other patents cited did not.

In E.P.A. No. 62,589, there was described a device in which the first part is composed of two horns defining together two rigid bearing surfaces, with a groove in between the horns, and the second part being formed by a base mounted on the door frame (or leaf), a flexible arm integral with the base and a catch tenon or catch piece integral with the free end of the flexible arm, and at closing, the arm lodges automatically in the groove and, at opening, the catch tenon catches on to one of the bearing surfaces of the first part.

One principal object of the present invention consists of providing for a device of the type mentioned above but removable from the respective leaf or frame in such a way that no young child could remove same.

Another object of the invention consists of providing for an apparatus as mentioned above, again on the first part, other means rendering the separation of the two pieces still more difficult, which would permit, for example, in the case of an application to a sash window, leaving it within the reach of children.

Another object of the invention consists of providing a variant of the part with two horns.

The characteristics of the above mentioned invention, as well as others, will become more apparent by the reading of following description or examples of realization, the said description having been done in relation to the adjoining drawings.

SUMMARY OF THE INVENTION

Following one characteristic of the invention, the first and second parts are both comprised of two pieces, of which the first is in fact secured to the frame (or leaf) (i.e., the attachment member), this first piece containing a slide (or slide-way) whereas the second piece which contains the locking mechanism (e.g., the horns) or the latch member (e.g., arm with tenon) and has its base in the form of a slide-way (or slide) adapted to the slide (or slide-way) of the first piece.

Under these conditions, it suffices that an adult in the absence of a child may uncouple the second pieces from the first pieces to free the doors.

It must also be noted that such devices where the first and second parts are in two pieces clearly facilitates its installation into drawers, where it suffices to install on the stationary part of the furniture a relatively flat piece onto which then slides the other larger piece.

Following another characteristic, every first and second piece of one part contains bolting mechanisms, to avoid all untimely uncoupling.

Following another characteristic of the invention, the device has been provided in which the first part consists of a first pair of horns separated by a first groove and a second pair of horns separated by a second groove, the first and second pair of horns being arranged one behind (or above) the other, the first and second grooves being aligned according to the direction of the arm of the second part, the pairs of horns being adapted obliquely with respect to the said direction by forming an angle equal to it, but in different directions with respect to it.

Following another characteristic of the invention, the first part is formed by a block comprised of an opening in front of the tenons of the arm of the second part, the interior surfaces of the opening contains two helicoidal inclines, with which the ends of the tenons enter in contact at closing, and which makes them rotate or turn around the axis of the arm, the depth of the opening being such that at complete closing, when the tenons have gone beyond the inclines, they turn in the opposite direction due to the elasticity of the arm and catch behind the block.

DESCRIPTION OF THE PREFERRED EMBODIMENTS

Figure 1:
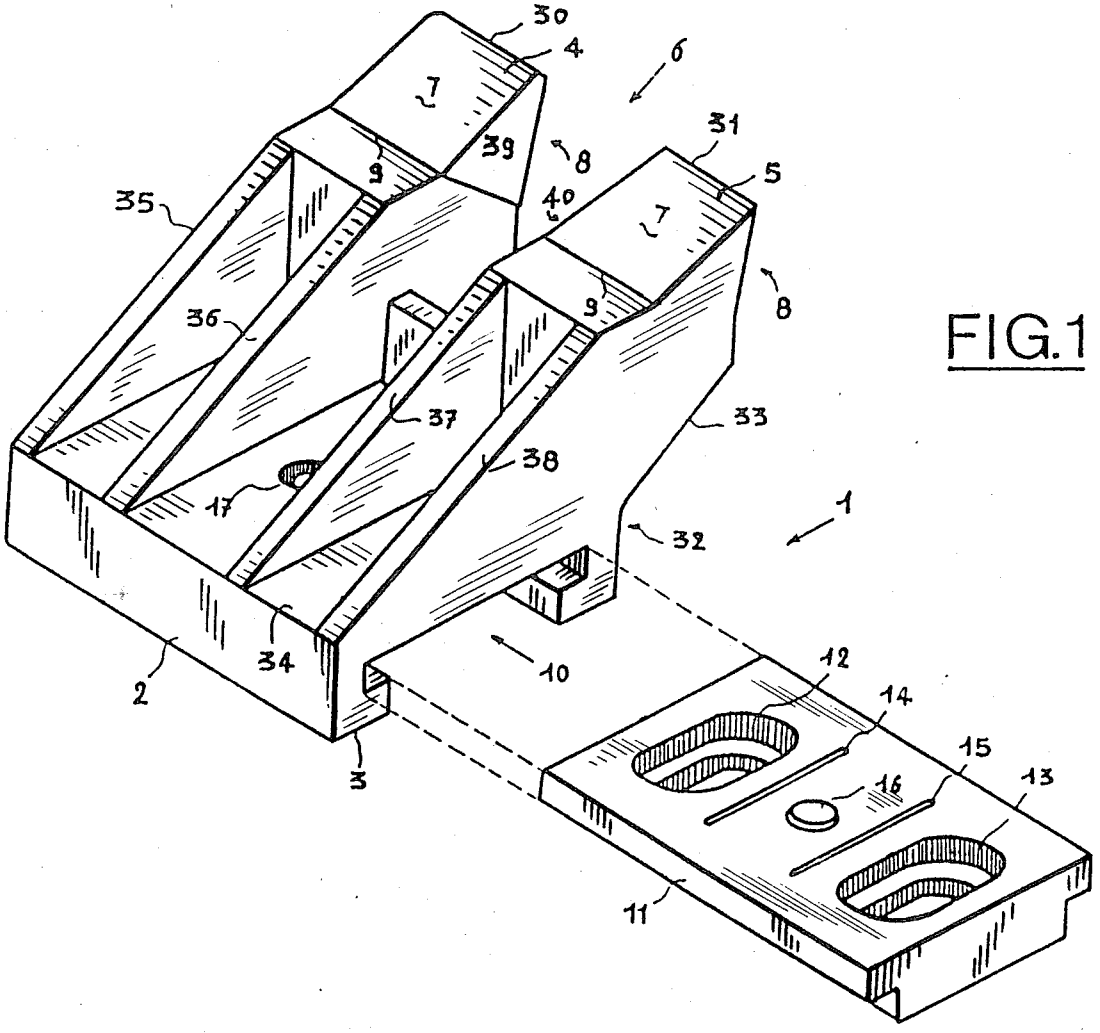
FIG. 1 is an exploded view in perspective of the first part of the apparatus according to the invention.

The first part of FIG. 1 shows the part composed of a base 2, approximately parallelepipedal, with a face 3 which is mounted on the face of a door frame (not shown), and two horn shaped elements 4 and 5, approximately oriented at 45° (forty-five degrees) with respect to the face 3. The horns 4 and 5 each contain a dihedron. In between the horns 4 and 5, appears a groove 6 of which the longitudinal direction is perpendicular to the direction of the aligned edges of dihedrons 4 and 5. Faces 7 and 8 of the dihedrons change incline at a certain distance from the line of the edges in order to form concave bearing surfaces 9.

The face 3 of the base 2 presents a hollow 10 in the form of a "T"-shaped slide-way by cross section. A slide 11, equally in tee at cross section can slip into the slide-way 10. The sliding direction of the slide 11 into the slide-way 10 is parallel to the line of the edges of horns 4 and 5, that is, perpendicular to the longitudinal direction of groove 6. The T-section of the slide 11 adapts into the T-section of the slide-way 10. The length of 11 is equal to that of 10.

The slide 11 contains two oblong counter-bored holes 12 and 13 for affixing said slide against the face of the frame by means of screws or bolts (not shown). Slide 11 contains a locking teat 16 and slits 14 and 15 to assist in locking 11 into 10. Moreover, the matter under the teat 16 has been grooved out or formed so as to provide a reduced thickness underneath and two slits 14 and 15 have been provided in order to give this median zone a certain flexibility or suppleness in the perpendicular direction of the plane of the slide. In the center of the median zone, the face of the slide 11, turned toward the base 2, presents 16 forming the bolting teat. Furthermore, the wall of the base 2 above the slide-way 10 presents in the center of its median zone, a through hole 17, open at its two extremities. The diameter of the hole 17 is practically equal to that of the bolting teat 16.

In order to affix the first part to the frame, the slide 11 should be affixed appropriately with screws (not shown) through the holes 12 and 13. Next, the slide-way 10 of 2 is slipped onto the slide 11. As the bolting teat 16 enters the slide way, the supple median zone of 11 is depressed and lowers and when the bolting teat 16 arrives at the hole 17, it raises itself, assuring the bolting of the two parts.

It must be noted that the effort of the arm of the second part on the horns 4 and 5 is perpendicular to the direction of the slide-way so that no accidental slipping between 2 and 11 is possible In order to uncouple 2 and 11 it is necessary to drive the bolting teat 16 engaged in the hole 17, into recession, with a simple tool such as the tip of a screwdriver, to permit the sliding of 2 with respect to 11.

Figures 2, 3:
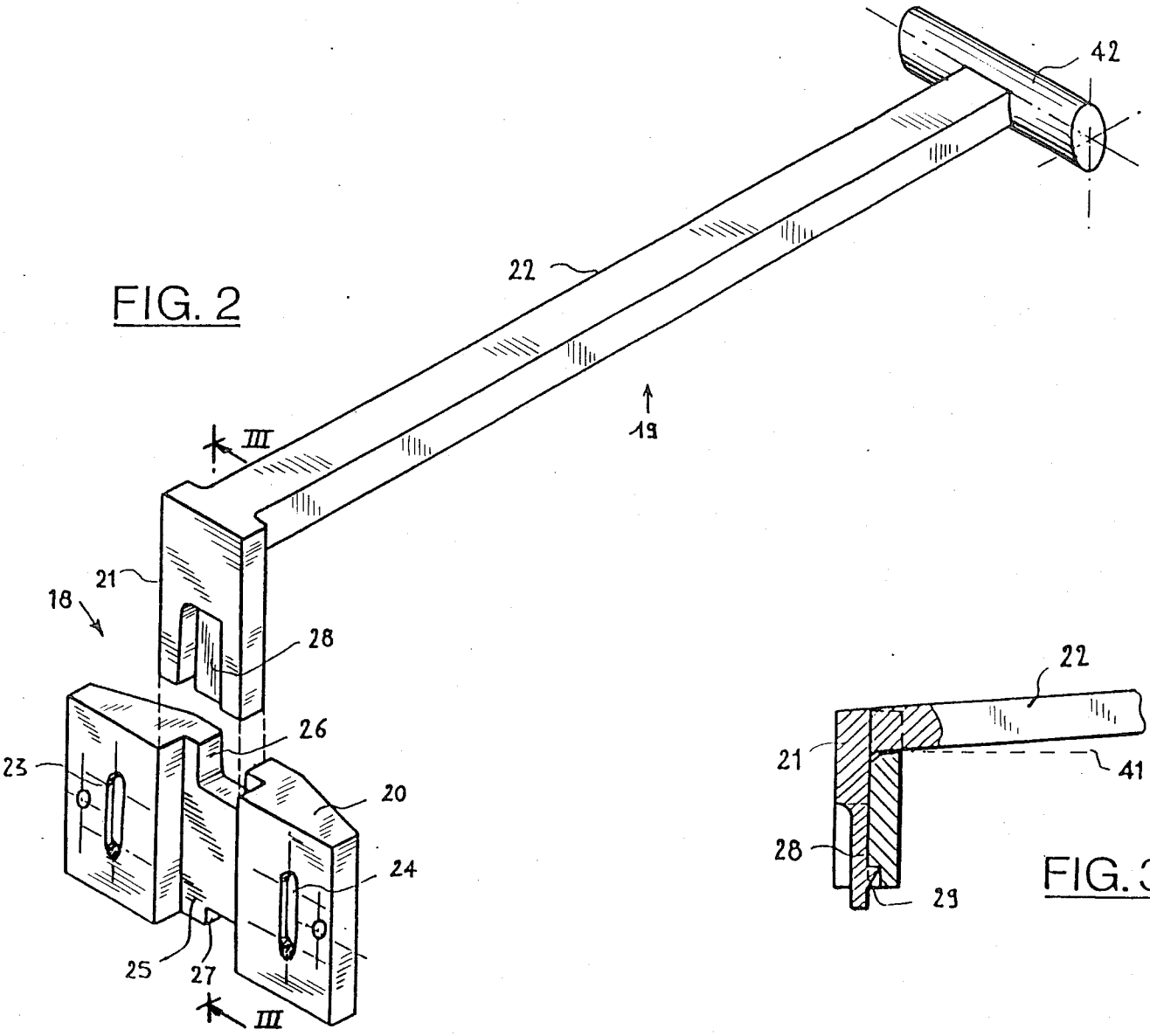
FIG. 2 is an exploded view in perspective of the second part of the apparatus according to the invention.
FIG. 3 is a partial view of the second piece of FIG. 2, according to line III—III, both pieces being assembled.

Referring to FIG. 2, the base 18 of the second part is also composed of two pieces: viz. a small plate 20, which is applied to the leaf or frame and a foot 21 of the arm 22.

The small plate 20 contains two oblong holes 23 and 24 for affixing to the leaf or frame (not shown), and a slide-way 25 with a rectangular cross section. The cross section of the foot 21 is equally rectangular and practically equal to that of 25. The slide-way 25 is open toward the face of the leaf or frame upon which is affixed the small plate 20.

The lateral wall is less thick, thus forming the slide-way 25 containing at both extremities of 25, notches 26 and 27. The shape of the notch 26 is identical to the cross section of the arm 22.

The thickness of the lower end of the foot 21 is reduced at its mid-portion, which enters first into contact with the slide-way 25 and has two longitudinal slots, open toward the bottom, there defining a supple bolt 28. As shown in the section of FIG. 3, when the foot 21 is coupled with the small plate 20, the bolt 28, of which the lower extremity 29 presents a flange, catches itself by this flange into the notch 27, which functions as a lock. In this way, the two pieces are bolted. The bolt 28, is slightly longer than the slide-way 25, and thus goes beyond the small plate 20. In order to unlock the two pieces, it suffices to press on the end of the bolt 28 with, for example, the tip of a screwdriver.

It should be noted that, with respect to the parallelepipedal base 2, the aligned edges 30 and 31 of the horns 4 and 5 are projected outside the limits of the plane of face 3, that is beyond its longitudinal limit 32, closest to the horns. Between the lower end of face 8 and this limit 32, is provided a ramp 33 of which the plane forms a 45 degree angle with the face 3. Furthermore, between the lower end of the base 7 and the limit 34 of base 2, opposite 33, is also provided a bearing surface in the form of a ramp composed of the backs of the four ribs 35 to 38 which arise on the upper face of base 2. The ramp defined by 35 to 38 aids the climb of the tenon of the other part of the apparatus until it goes past the edges 30 and 31 to catch behind the face 8.

The faces 39 and 40 of horns 4 and 5 which face the groove 6 have their respective planes slightly spread to facilitate the passage of the arm of the other part of the apparatus, at the time of locking.

From FIG. 3, it appears that the arm 22 is not rigorously perpendicular to the foot 21, but forms with the norm a certain angle 41 of, for example, 5 to 6 degrees. This angle has been provided so that even though a door is ajar, the tenon or catch piece 42 of the arm has less of a tendency to move away from the horns 4 and 5, thus insuring a positive catch.

Upon examination of FIGS. 1 and 2, as well as from the preceding description, it appears that when one does not wish to use the device limiting the distance that a door leaf may be opened, that is to say that when there are no children in the home, one can easily remove the moveable parts from the parts fixed to the leaf, frame and the like. Reinsertion of these parts can also be rapidly executed.

Figure 6:
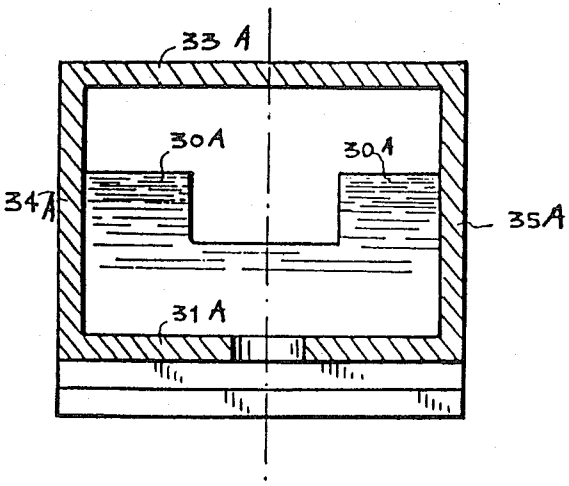
FIGS. 4 to 6 are respectively a top view, one sectional view according to line V—V of FIG. 4 and one sectional view according to the line VI—VI of FIG. 5 of a variant of the first part.
Figure 5:
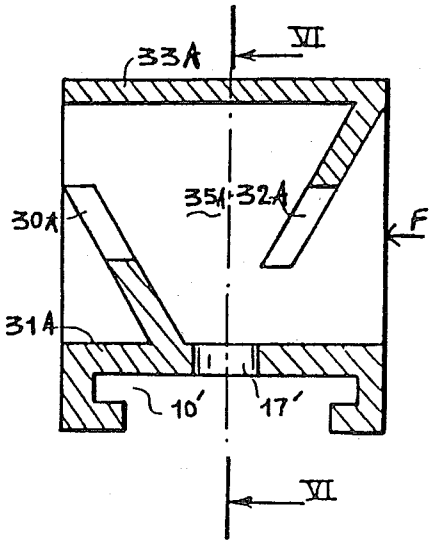
Figure 4:
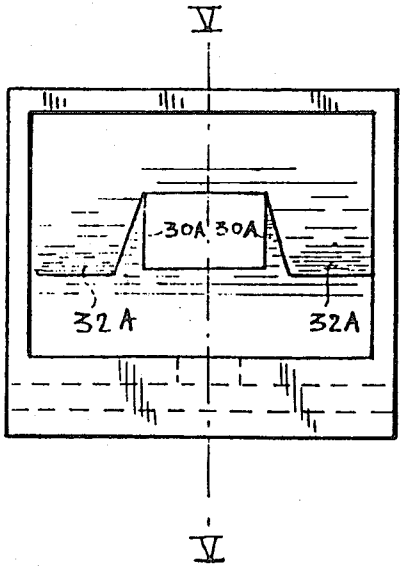

The piece shown in FIGS. 4 to 6 is a variant of the piece in FIG. 1 and is notably usable for limiting the opening of sash windows as well as swinging and sliding doors and windows. Under a certain form, it consists of a piece which contains two pairs of horns. One pair of horns 30A is fixed onto the base 31A as in FIG. 1, and the other pair of horns 32A is fixed onto a frontal wall 33A which is made integral to the base 31A by lateral walls 34A and 35A. The base 31A contains a slide-way 10' as in 2, with a central hole 17'.

With respect to the entry direction of the arm of the other piece, this direction is indicated by the arrow F of Fig. 5. The horns are directed in the same direction so as to permit the cylindrical tenon or catch piece of the arm to first contour or ride the horns 32A and then behind the horns 30A on which it catches.

As shown in the section of FIG. 5, the horns 30A and 32A are directed one toward the other, the tip of the horns 30A being flush on top of the piece while the bottoms of the horns 32A are underneath the piece. Between the tips of 32A and the wall 31A on the one hand, and between the tips of 30A and the wall 33A on the other hand, the space is sufficient so that the tenon or catch piece of the arm can pass freely.

One can understand that with the piece of FIGS. 4 to 6, once the tenon of the arm is engaged behind 30A, it must first be pushed toward 33A in order displace the catch piece a first time, then the arm must be pushed toward 31A in order to liberate the catch piece completely.

The slide-way 10'adapts itself normally onto a slide such as 11 (not shown in FIGS. 4–6), as in the FIG. 1, and the hole 17' is clearly accessible, between the horns 32A in order to push the locking bolt.

Figure 8:
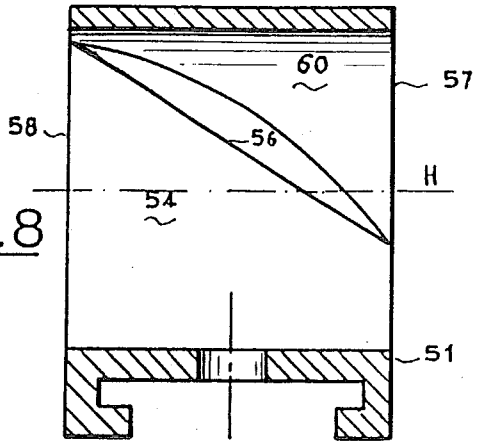
FIGS. 7 to 9 are respectively front view, one sectional view according to line VIII—VIII of FIG. 7 and one top view of a variant of the first part.
Figure 9:
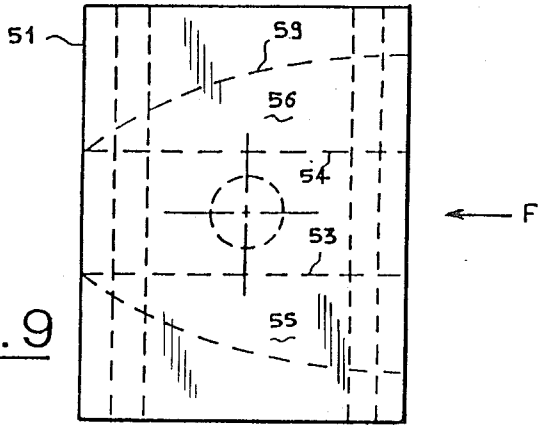
Figure 7:
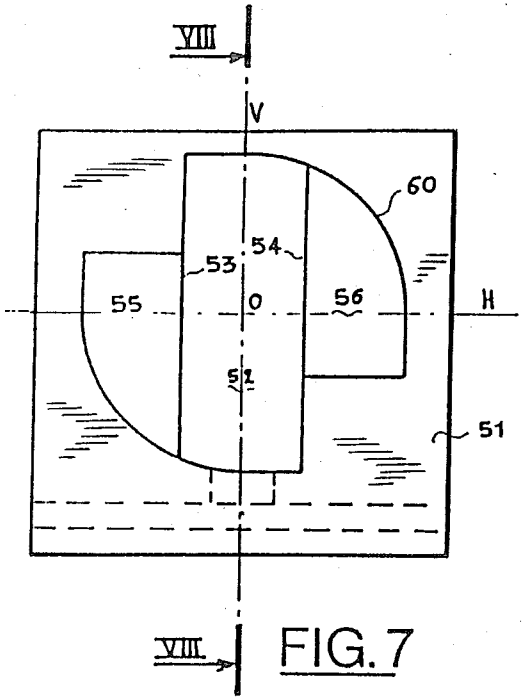

Another variant of the piece designed to cooperate with a second piece, as with that which is shown in the FIG. 25 is shown by the views of FIGS. 7 to 9 and is also notably and particularly usable for limiting the opening of sash windows. Before describing this variant in detail, reference should be made to the schematic representation of FIG. 10. Here is represented the tenon 42, and the arm 22 of piece 19, which is pushed along a straight line D, in the direction of the arrow F, in order to go into the locking position. The first piece is schematically represented by two right prisms 43 and 44 of which the edges are perpendicular to the straight line D and symmetrical with respect to it. In the follow-up, one could suppose that the plane defined by D and the axis of the tenon 42 is a horizontal plane H. The prism 43 has an oblique face 45 of which the superior rim 46 is a little above the plane H and the inferior rim 49 a little under the plane H. Symmetrically, the prism 44 has an oblique face 48 with an inferior rim 49 a little under the plane H and a superior rim 50 a little above it. The prisms are separated by an interval of which the width is less than the length of the tenon 42.

Figure 10:
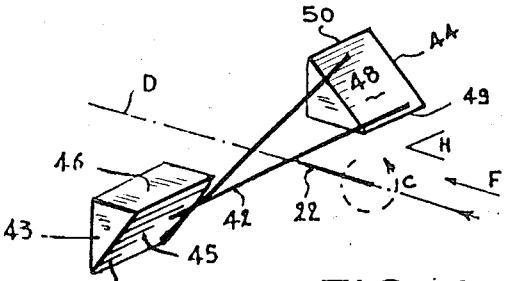
FIG. 10 is a schematic view illustrating the operation of the part in FIGS. 7 to 9.

As shown in FIG. 10, when the tenon or catch piece encounters the prisms 43 and 44, while moving according to the arrow F, one of its extremities goes up the length of 44 whereas the other goes down the length of 43. The arm 22 becomes twisted as indicated by the arrow C. When the extremities of the tenon 42 go beyond the rims 47 and 50 respectively, they are no longer untwisted and the elasticity of the arm 22 untwists them to turn in the opposite direction of the arrow C, so that the tenon catches behind the prisms.

It should be noted that this operation is obtained when the distance between the prisms is sufficiently great so that the extremities of the tenon pass over 50 and 47 before rubbing against the lateral walls of the prism. If this distance is shortened, this rubbing occurs, and the tenon will again lock behind the prisms.

The piece 51 of the FIG. 7 is a parallelepidedal block pierced through by an opening 52 delimited by two lateral walls 53 and 54. The opening 52 is equally symmetrical with respect to the intersecting line O of the vertical plane V and the horizontal plane H. With respect to the line O, through the walls 53 and 54 are provided symmetrical cavities defined by inclines 55 and 56, which play the role of the faces 45 and 48 of the FIG. 10.

The inclines 55 and 56 go from the frontal face 57 to the rear face 58 of the piece 51. They are preferrably portions of helicoidal surfaces. Effectively, as shown in FIG. 10, tenon 42, while advancing and turning and bearing on the oblique edges of 43 and 44, defines helicoidal trajectories, the results being that the tenon is only in contact with 45 and 48 when it first enters into contact with them. It then rubs against the two sharp edges. If helicoidal forms are provided to the inclined surfaces, the tenon will bear smoothly on several points.

As shown by line 59 of FIG. 9, the cavity above the incline 56 has its width which diminishes in the direction of arrow F, which is normal because as the tenon 42 gradually continues to turn, its projected length on the horizontal plane diminishes. We then have above 56, an arch shown as 60 in FIG. 8. In that which concerns the incline 55, we have symmetrical surfaces of those of 56 with respect to the line O. The tenon or catch piece 42 arrives at the end of the inclines 55 and 56 practically vertical so as to then catch behind the rear face 58. In order to unlock the catch pieces, the tenon 42 must be twisted in the opposite direction and pushed so that it passes in the slit 52, which is a most difficult operation for a young child.

The lower face of the piece 51 contains a slide-way similar to that of the piece of FIG. 1, in order to be slid on a slide such as 11.

What is claimed is:

1. A latch assembly comprising a first member and a second member, said first and second members being formed with respective means for catching said first member in said second member upon movement of said members towards each other, and a first attachment member and second attachment member, each being formed with means for attaching to one of a fixed and a moveable frame member, with at least on of said first and second members and respective first and second attachment members being formed with cooperative attachment means for selectively attaching the respective first or second member to the respective attachment member, said first member being formed with a flexible arm and a transversely disposed catch piece at the end thereof and said second member being formed with catch means to hold the catch piece upon said movement of said members towards each other, said catch means comprising a first pair of horns forming a first groove and a second pair of horns being disposed behind said first pair of horns, said pairs of horns being obliquely disposed in opposite directions, said horns forming an opening when viewed from the direction of said first member towards the second member, with the grooves aligned to receive the arm in the opening with the catch piece disposed behind the pairs of arms.

2. The latch assembly of claim 1, said horns forming a rectilinear opening, and said arm being rectilinear in cross-section to be received in said opening.

3. The latch assembly of claim 1, said catch piece having a curved surface, said curved surface slidably engaging said first pair of horns and then said second pair of horns upon said movement of said members toward each other.

* * * * *